United States Patent [19]

Harlow

[11] 4,063,363

[45] Dec. 20, 1977

[54] ROLL GAP MEASUREMENT

[75] Inventor: Robert James Harlow, Poole, England

[73] Assignee: Loewy Robertson Engineering Company Limited, Poole, England

[21] Appl. No.: 648,515

[22] Filed: Jan. 12, 1976

[30] Foreign Application Priority Data

Jan. 14, 1975 United Kingdom ..... 1513/75

[51] Int. Cl.[2] ..... B21B 37/08

[52] U.S. Cl. ..... 33/182; 33/143 M

[58] Field of Search ..... 33/182, 143 L, 147 N, 33/143 M, 147 K, 147 T, 143 G, 143 K

[56] References Cited

U.S. PATENT DOCUMENTS

| | | | |
|---|---|---|---|
| 1,319,834 | 10/1919 | Blake | 33/182 X |
| 1,507,930 | 9/1924 | McDonough | 33/182 |
| 1,598,248 | 8/1926 | Paine | 33/143 M |
| 3,937,271 | 2/1976 | Akiba et al. | 33/182 X |
| 3,943,634 | 3/1976 | Lindermann et al. | 33/182 |

FOREIGN PATENT DOCUMENTS

| | | | |
|---|---|---|---|
| 1,102,947 | 10/1955 | France | 33/182 |

*Primary Examiner*—William D. Martin, Jr.
*Attorney, Agent, or Firm*—Brisebois & Kruger

[57] ABSTRACT

In order to indicate the gap between the work rolls of a rolling mill, a pair of shoe structures are urged into engagement with the necks of the respective work rolls, so as to engage that part of the upper roll neck which is vertically beneath the roll axis and that part of the lower roll neck which is vertically above the roll axis and to be movable with the rolls in the vertical direction and an electrical transducer is carried by one of the shoe structures at a position away from the roll axis and a movable part of the transducer engages the other shoe structure so that the electrical output of the transducer varies in response to a variation in the gap between the rolls.

7 Claims, 2 Drawing Figures

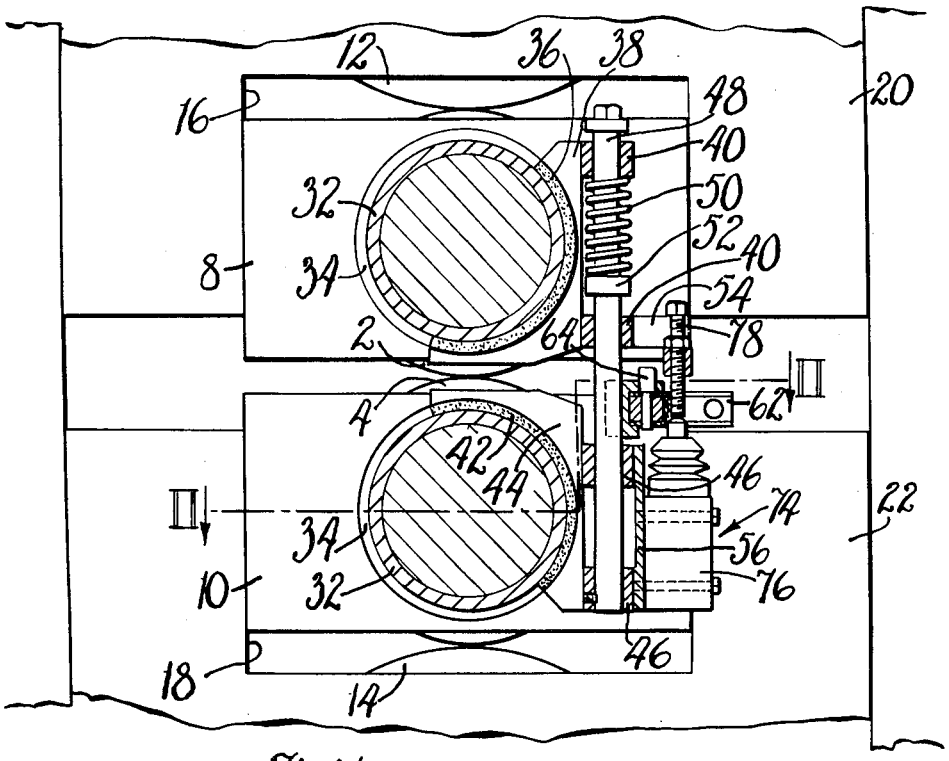
Fig. 1.
Fig. 2
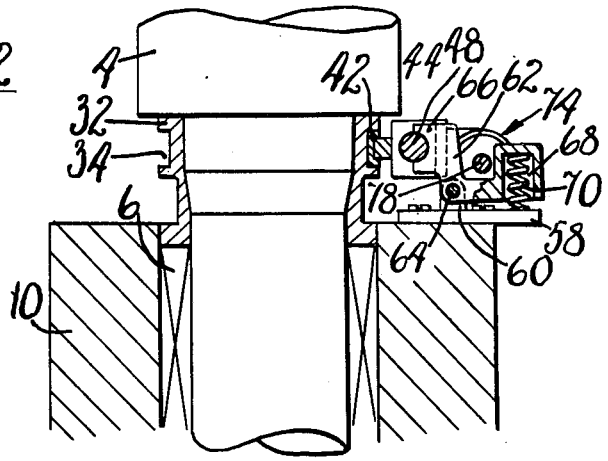

ROLL GAP MEASUREMENT

This invention relates to apparatus for indicating the gap between the work rolls of a rolling mill and to a rolling mill provided with such apparatus.

A known arrangement for measuring the gap between the work rolls of a rolling mill consists of transducers located between the necks of the rolls so that movement of the rolls towards and away from each other causes the electrical output of the transducers to vary. In order to obtain an accurate measurement it is desirable for the transducers to be positioned as close as possible to the roll barrels and in the plane of the roll centres. However, the small space which is present between the bearing chock assemblies supporting the roll necks is not usually sufficient to accommodate the transducers.

It is an object of the present invention to overcome this difficulty in apparatus which is suitable for indicating the roll gap between the work rolls of a rolling mill.

According to a first aspect of the present invention, apparatus for indicating the gap between the work rolls of a rolling mill comprises a pair of shoe structures, means for urging the structures into direct or indirect sliding engagement with the necks of the upper and lower work rolls respectively of a rolling mill, the structures engaging that part of the neck of the upper roll which is vertically beneath the roll axis and that part of the neck of the lower roll which is vertically above the roll axis and being movable with the rolls in the vertical direction normal to their longitudinal axes, an electrical transducer having a first elongate part movable in the direction of its length with respect to a second part of the transducer, said second part being carried by one of the shoe structures in a position away from the roll contacting part thereof and the first part being engageable with the other shoe structure such that the direction of relative movement of the two parts is parallel to the direction of separation of the shoe structures whereby the electrical output of the transducer varies in response to a variation in the gap between the work rolls.

According to a second aspect of the present invention, rolling mill has upper and lower work rolls and apparatus for indicating the gap between the rolls, said apparatus comprising a pair of shoe structures, means urging one of the structures into direct or indirect sliding engagement with at least that part of the neck of the upper roll which is vertically beneath the roll axis, and the other structure into direct or indirect sliding engagement with at least that part of the neck of the lower roll which is vertically above the roll axis so that the structures are movable with the rolls in the vertical direction normal to their longitudinal axes, an electrical transducer having a first elongate part movable in the direction of its length with respect to a second part of the transducer, said second part being carried by one of the shoe structures in a position away from the roll contacting part thereof and the first part being engageable with the other shoe structure so that the direction of relative movement of the two parts is parallel to the direction of separation of the shoe structures whereby the electrical output of the transducer varies in response to a variation in the gap between the work rolls.

Although the transducer is positioned away from the plane of the roll axes it still provides an accurate indication of the gap between the work rolls because the shoe structures each have a part engageable with the roll necks in the gap between the rolls and in the plane containing the roll axes.

In order that the invention may be more readily understood it will now be described, by way of example only, with reference to the drawing filed with the provisional specification, in which:

FIG. 1 is an end view, partly in section, of part of a rolling mill fitted with the roll gap measuring apparatus, and FIG. 2 is a sectional view on the line II—II of FIG. 1.

A rolling mill has upper and lower work rolls 2, 4 supported at their ends in bearings 6 carried by bearing chock assemblies 8, 10 respectively. The work rolls are provided with back-up rolls 12, 14 respectively and the chocks 8, 10 are slidably mounted in recess 16, 18 in the chocks 20, 22 of the back-up rolls.

A tightly fitting sleeve 32 is mounted on the roll neck of each of the work rolls and each sleeve is formed with a groove 34 around its periphery. The apparatus for indicating the gap between the work rolls comprises a pair of shoe structures each having a part which is biased into engagement with the roll necks. The structure associated with the upper work roll comprises a shoe 36 of arcuate form which fits into the groove 34 in the sleeve 32 on the upper roll. The shoe extends around part of the length of the groove including that part of the groove immediately beneath the longitudinal axis of the top roll. The shoe is mounted on a plate 38 which has a pair of lugs 40 projecting from it. A similar shoe 42 engages in the groove 34 of the sleeve on the neck of the lower work roll. The shoe extends around approximately 160° of the groove including that part of the groove immediately above the longitudinal axis of the bottom work roll. The shoe is mounted on a plate 44 which supports a pair of lugs 46. A post 48 passes through the lugs 46 and is secured thereto by suitable set screws. The post also passes through the lugs 40 on the plate 38. A compression spring 50 is located around the post, between the underside of the upper lug 40 and a collar 52 secured to the post. The spring effectively urges the plates 38, 44 apart and hence the shoes 36, 42 are urged into close contact with the grooves 34 in the plane of the roll centres. The lower lug 40 carries an outwardly extending extension plate 54 and the lugs 46 are bridged by a support plate 56.

The lower work roll chock has a plate 58 secured to it and the plate carries a lug 60. A bell crank lever 62 is pivoted on a pin 64 carried in the lug and one arm of the lever carries a pad 66 and the second arm of the lever is formed with a recess 68 and a spring 70 is seated in the recess and engages with the plate 58. As shown in FIG. 2 the action of the spring 70 causes the bell crank lever to pivot anticlockwise and for the pad 66 to bear against the post 48. The shoes 36 and 42 are thus urged horizontally into close engagement with the grooves 34 in the sleeves 32. An electrical transducer 74 has a stationary part 76 carried on the plate 56 and a movable part which abuts against an adjusting screw 78 on the plate 54. The direction of movement between the two parts of the transducer is parallel to the vertical plane containing the roll centres. Any movement of the mill towards or away from each other in the vertical plane will result in a corresponding movement of the shoes 36, 42 and the screw 78 will move towards or away from the body of the transducer 74 by a similar amount. The electrical output from the transducer will therefore be indicative of a change in roll gap. This signal can be utilized either as a display, or to control the actuation of, for example, a hydraulic cylinder to close or open the roll gap accordingly.

When it is necessary to change the work rolls of the mill, the roll gap measuring device has to be removed. This is a fairly simple operation and it involves removing the pin 64 and pressing the shoes and their mounting plates towards each other against the action of the spring 50 and the entire assembly along with the transducer 74 is then withdrawn towards the right as seen in FIG. 1.

It is desirable for such an assembly as shown in FIGS. 1 and 2 to be positioned at each end of the work rolls and furthermore it may be desirable for a transducer to be positioned on both sides of the vertical plane containing the centres of the rolls. The assembly shown to the right of the roll centres in FIG. 1 may be duplicated on the left-hand side of the roll centres with the shoes bearing in either the same or a separate groove in the sleeves on the roll necks. The shoes may extend around the periphery of the rolls for approximately 180° or each pair of shoes may be as shown in FIG. 1.

I claim:

1. The improved apparatus for indicating the extent of the gap between the work rolls of a rolling mill having a pair of work rolls arranged with their axes of rotation in a vertical plane, which apparatus comprises:

support means secured to the mill adjacent one end of the rolls and on one side of the vertical plane containing the roll axes, a vertical post positioned on said side of the vertical plane, a pair of structures mounted on the post and each having an arcuate shoe which projects into the space between the rolls at said end thereof, means removably mounted on the support means which applies a horizontal biassing force to said post and thereby urges one of the shoes into slidable engagement with a part of the upper work roll which is immediately below the axis of said upper work roll, and the other shoe into slidable engagement with a part of the lower work roll which is immediately above the axis of said lower work roll, an electrical transducer having a first elongate part movable in the direction of its length with respect to a second part of the transducer, said second part being carried by one of said structures on said one side of the vertical plane and in a position away from the rolls, and the first part being positioned to engage the other structure and move in a vertical direction in response to a variation in the gap between the work rolls, thereby varying the electrical output of said transducer.

2. A rolling mill as claimed in claim 1, including a spring acting between the shoe structures in the direction to separate said structures.

3. A rolling mill as claimed in claim 2 in which one of the shoe structures is secured to the post and the other structure is slidably mounted on the post and said spring is secured to the post and acts against the movable structure.

4. A rolling mill as claimed in claim 3 in which said biassing means includes a pad and means acting horizontally to urge the pad into engagement with the post to direct the post toward the roll axes.

5. A rolling mill as claimed in claim 4 in which said pad is mounted on one limb of a two-limbed bell crank lever and a spring acts against the other limb to pivot the lever in a direction to urge the pad into engagement with the post.

6. A rolling mill as claimed in claim 1 in which each of said rolls has a neck portion adjacent said end, each neck portion having a sleeve tightly fitted thereon, each sleeve having a circumferential groove therein, and in which said shoes project into respective grooves.

7. A rolling mill as claimed in claim 5 comprising a lug projecting from said suport means, and a pin removably mounted in the lug, said bell crank lever being pivotally mounted on said pin.

* * * * *